US005506538A

United States Patent [19]

Liu

[11] Patent Number: 5,506,538

[45] Date of Patent: Apr. 9, 1996

[54] VECTOR SUMMATION DEVICE

[75] Inventor: Shen-Iuan Liu, Chi-Lung, Taiwan

[73] Assignee: National Science Council of R.O.C., Taipei, Taiwan

[21] Appl. No.: 433,837

[22] Filed: May 4, 1995

[51] Int. Cl.[6] ..... G06G 7/16

[52] U.S. Cl. ..... 327/361; 327/347; 327/349

[58] Field of Search ..... 327/347, 349, 327/361

[56] References Cited

U.S. PATENT DOCUMENTS 4,575,811 3/1986 Hammond et al. ..... 327/361

4,585,961 4/1986 Daubert ..... 327/361

*Primary Examiner*—Margaret R. Wambach

*Attorney, Agent, or Firm*—Bell, Seltzer, Park & Gibson

[57] ABSTRACT

A vector summation device includes a squaring circuit for receiving a number of input voltage signals, and a square-root circuit having first and second current terminals connected electrically to the squaring unit. The squaring circuit receives first and second current signals respectively from the first and second current terminals of the square-root circuit. The difference between the current values of the first and second current signals is proportional to the sum of the squares of the voltage values of the input voltage signals. The square-root circuit generates an output voltage signal with a voltage value that is proportional to the square-root of the difference between the current values of the first and second current signals.

15 Claims, 3 Drawing Sheets

IA
IB
IX2,2
IX1,2
IX1,1
IX2,1
-X2
-X1
X1
X2
M16
M15
M14
M3
M12
M11
M10
M9
M6
M5
M8
M7
M2
M1
M14
M13
2I6
2I5
VC
VDD
VSS
Ib
Ia
V2
V1
MCM21
MCM22
MCM11
MCM12
MCM2
MCM1

VECTOR SUMMATION DEVICE

BACKGROUND OF THE INVENTION

1. Field of the Invention

This invention relates to a vector summation device, more particularly to a vector summation device which generates an output voltage signal with a voltage value proportional to the square-root of the sum of the squares of the voltage values of a number of input voltage signals provided thereto.

2. Description of the Related Art

Presently, conventional vector summation devices usually employ a large number of bipolar junction transistors as its primary electrical components, thereby resulting in a complicated circuit. Furthermore, the conventional vector summation device is unsuitable for use in VLSI circuits.

SUMMARY OF THE INVENTION

Therefore, the main objective of the present invention is to provide a vector summation device which includes a squaring circuit for receiving a number of input voltage signals and a square-root circuit for generating an output voltage signal with a voltage value proportional to the square-root of the sum of the squares of the voltage values of the input voltage signals, the squaring and square-root circuits implementable using MOS transistors to result in a circuit which is simpler than that of the prior art.

According to the present invention, a vector summation device includes a squaring circuit for receiving a number of input voltage signals, and a square-root circuit having first and second current terminals connected electrically to the squaring unit. The squaring circuit receives first and second current signals respectively from the first and second current terminals of the square-root circuit. The difference between the current values of the first and second current signals is proportional to the sum of the squares of the voltage values of the input voltage signals. The square-root circuit generates an output voltage signal with a voltage value proportional to the square-root of the difference between the current values of the first and second current signals.

BRIEF DESCRIPTION OF THE DRAWINGS

Other features and advantages of the present invention will become apparent in the following detained description of the preferred embodiments, with reference to the accompanying drawings, of which.

DETAILED DESCRIPTION OF THE PREFERRED EMBODIMENT

Figure 1:
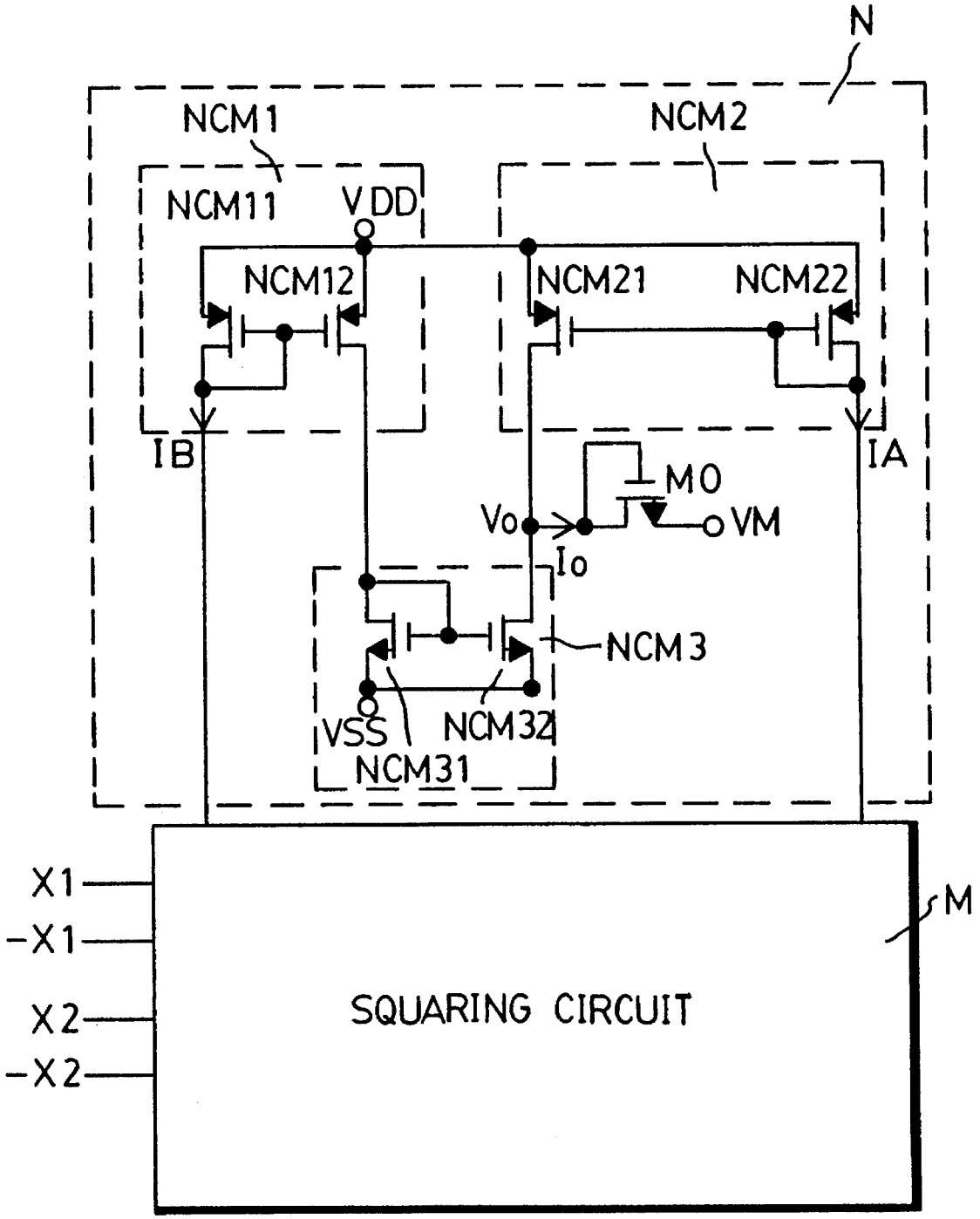
FIG. 1 is a schematic circuit diagram of a vector summation device according to a first embodiment of the present invention.

Referring to FIG. 1, a vector summation device according to the present invention includes a squaring circuit (M) for receiving a number of input voltage signals, and a square-root circuit (N) having first and second current terminals connected electrically to the squaring unit (M).

Figure 2:
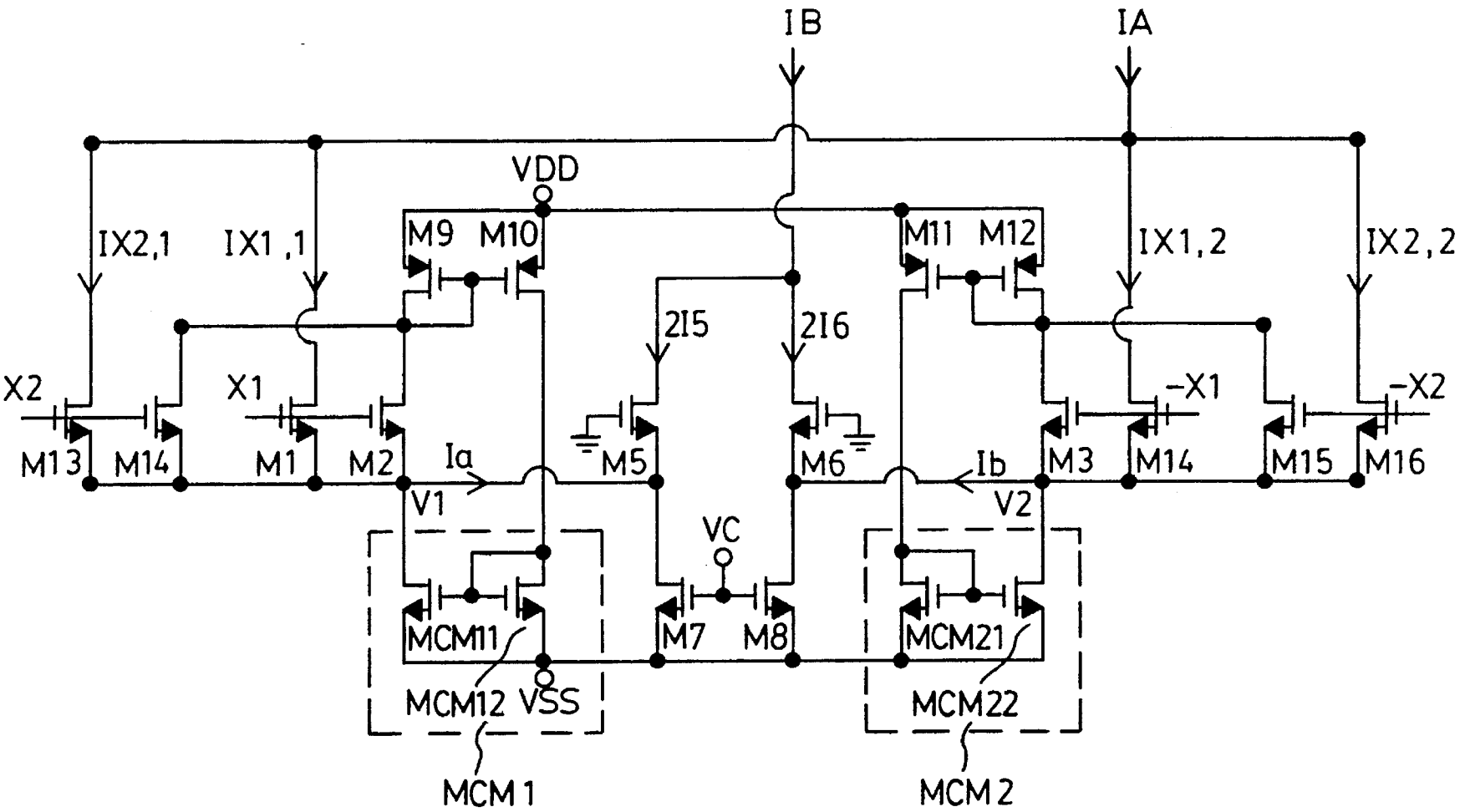
FIG. 2 is a schematic circuit diagram of a squaring circuit of the vector summation device according to the first embodiment of the present invention.

In the present embodiment, the squaring circuit (M) is shown to receive two input voltage signals (X1,X2). The squaring circuit (M) has two input terminal pairs for receiving respectively the input voltage signals (X1,X2). Referring to FIG. 2, the squaring circuit (M) includes first and second field effect transistors (M1 and M2) having interconnected gate terminals which serve as a first input terminal of a first one of the input terminal pairs, and interconnected source terminals. Each of the first and second transistors (M1 and M2) further has a drain terminal. The drain terminal of the first transistor (M1) is connected electrically to the first current terminal of the square-root circuit (N). Third and fourth field effect transistors (M3 and M4) have interconnected gate terminals which serve as a second input terminal of the first one of the input terminal pairs, and interconnected source terminals. Each of the third and fourth transistors (M3 and M4) further has a drain terminal. The drain terminal of the fourth transistor (M4) is connected electrically to the drain terminal of tile first transistor (M1). A fifth field effect transistor (M5) has a grounded gate terminal, a source terminal connected electrically to the source terminal of the second transistor (M2), and a drain terminal connected electrically to the second terminal of the square-root circuit (N).

A sixth field effect transistor (M6) has a grounded gate terminal, a source terminal connected electrically to the source terminal of the third transistor (M3), and a drain terminal connected electrically to the drain terminal of the fifth transistor (M5). A seventh field effect transistor (M7) has a gate terminal connected electrically to a control voltage supply (VC), a source terminal connected to a negative voltage supply (VSS), and a drain terminal connected electrically to the source terminal of the second transistor (M2). An eighth field effect transistor (M8) has a gate terminal connected electrically to the gate terminal of the seventh transistor (M7), a source terminal connected electrically to the source terminal of the seventh transistor (M7), and a drain terminal connected electrically to the source terminal of the third transistor (M3). It should be noted that the control voltage supply (VC) provides a control voltage which permits current to flow through the drain terminals of the fifth and sixth transistors (M5 and M6).

A ninth field effect transistor (M9) has a gate terminal, a source terminal connected electrically to the gate terminal thereof and to the drain terminal of the second transistor (M2), and a drain terminal connected electrically to a positive voltage supply (VDD). A tenth field effect transistor (M10) has a gate terminal connected electrically to the gate terminal of the ninth transistor (M9), a source terminal, and a drain terminal connected electrically to the drain terminal of the ninth transistor (M9). A first current mirror circuit (MCM1) includes first and second NMOS field effect transistors (MCM11 and MCM12). The first transistor (MCM11) has a gate terminal, a source terminal which serves as a first output terminal of the first current mirror circuit (MCM1) and which is connected electrically to the negative voltage supply (VSS), and a drain terminal which serves as a first input terminal of the first current mirror circuit (MCM1) and which is connected electrically to the source terminal of the second transistor (M2). The second transistor (MCM12) has a gate terminal connected electrically to the gate terminal of the first transistor (MCM11), a source terminal which serves as a second output terminal of the first current mirror circuit (MCM1) and which is connected electrically to the negative voltage supply (VSS), and a drain terminal which serves as a second input terminal of the first current mirror circuit (MCM1) and which is connected electrically to the source terminal of the tenth transistor (M10).

An eleventh field effect transistor (M11) has a gate terminal, a source terminal, and a drain terminal connected electrically to the drain terminal of the ninth transistor (M9). A twelfth field effect transistor (M12) has a gate terminal connected electrically to the gate terminal of the eleventh transistor (M11), a source terminal connected electrically to the gate terminal thereof and to the drain terminal of the third transistor (M3), and a drain terminal connected electrically to the drain terminal of the ninth transistor (M9). A second current mirror circuit (MCM2) includes first and second NMOS field effect transistors (MCM21 and MCM22). The first transistor (MCM21) has a gate terminal, a source terminal which serves as a first output terminal of the second current mirror circuit (MCM2) and which is connected electrically to the negative voltage supply (VSS), and a drain terminal which serves as a first input terminal of the second current mirror circuit (MCM2) and which is connected electrically to the gate terminal thereof and to the source terminal of the eleventh transistor (M11). The second transistor (MCM22) has a gate terminal connected electrically to the gate terminal of the first transistor (MCM21), a source terminal which serves as a second output terminal of the second current mirror circuit (MCM2) and which is connected electrically to the negative voltage supply (VSS), and a drain terminal which serves as a second input terminal of the second current mirror circuit (MCM2) and which is connected electrically to the source terminal of the third transistor (M3).

Thirteenth and fourteenth field effect transistors (M13 and M14) have interconnected gate terminals which serve as a first input terminal of a second one of the input terminal pairs, and interconnected source terminals which are connected electrically to the source terminals of the first and second transistors (M1 and M2). The thirteenth transistor (M13) further has a drain terminal connected electrically to the drain terminal of the first transistor (M1). The fourteenth transistor (M14) further has a drain terminal connected electrically to the drain terminal of the second transistor (M2). Fifteenth and sixteenth field effect transistors (M15 and M16) have interconnected gate terminals which serve as a second input terminal of the second one of the input terminal pairs, and interconnected source terminals which are connected electrically to the source terminals of the third and fourth transistors (M3 and M4). The fifteenth transistor (M15) further has a drain terminal connected electrically to the drain terminal of the third transistor (M3). The sixteenth transistor (M16) further has a drain terminal connected electrically to the drain terminal of the first transistor (M1). It should be noted that, in the present embodiment, the first, second, third, fourth, fifth, sixth, seventh and eighth field effect transistors (M1, M2, M3, M4, M5, M6, M7 and MS) are NMOS field effect transistors. The ninth, tenth, eleventh and twelfth field effect transistors (M9, M10, M11 and M12) are PMOS field effect transistors. The thirteenth, fourteenth, fifteenth and sixteenth field effect transistors (M13, M14, M15 and M16) are NMOS field effect transistors.

Referring to FIGS. 1 and 2, the square-root circuit (N) includes a first current mirror circuit (NCM1) having first and second PMOS field effect transistors (NCM11,NCM12). The first transistor (NCM11) has a gate terminal, a source terminal which serves as a first output terminal of the first current mirror circuit (NCM1) and as the second current terminal of the square-root circuit (N) and which is connected electrically to the gate terminal thereof and to the drain terminals of the fifth and sixth transistors (M5 and M6) of the squaring circuit (M), and a drain terminal which serves as a first input terminal of the first current mirror circuit (NCM1) and which is connected electrically to the positive voltage supply (VDD). The second transistor (NCM12) has a gate terminal connected electrically to the gate terminal of the first transistor (NCM11), a source terminal which serves as a second output terminal of the first current mirror circuit (NCM1), and a drain terminal which serves as a second input terminal of the first current mirror circuit (NCM1) and which is connected electrically to the positive voltage supply (VDD).

A second current mirror circuit (NCM2) includes first and second PMOS field effect transistors (NCM21 and NCM22). The first transistor (NCM21) has a gate terminal, a source terminal which serves as a first output terminal of the second current mirror circuit (NCM2), and a drain terminal which serves as a first input terminal of the second current mirror circuit (NCM2) and which is connected electrically to the positive voltage supply (VDD). The second transistor (NCM22) has a gate terminal connected electrically to the gate terminal of the first transistor (NCM21), a source terminal which serves as a second output terminal of the second current mirror circuit (NCM2) and as the first current terminal of the square-root circuit (N) and which is connected electrically to the gate terminal thereof and to the drain terminals of the first, fourth, thirteenth and sixteenth transistors (M1, M4, M13 and M16) of the squaring circuit (M), and a drain terminal which serves as a second input terminal of the second current mirror circuit (NCM2) and which is connected electrically to the positive voltage supply (VDD).

A third current mirror circuit (NCM3) includes first and second NMOS field effect transistors (NCM31 and NCM32). The first transistor (NCM31) has a gate terminal, a source terminal which serves as a first output terminal of the third current mirror circuit (NCM3) and which is connected to the negative voltage supply (VSS), and a drain terminal which serves as a first input terminal of the third current mirror circuit (NCM3) and which is connected electrically to the second output terminal of the first current mirror circuit (NCM1) and to the gate terminal thereof. The second transistor (NCM32) has a gate terminal connected electrically to the gate terminal of the first transistor (NCM31), a source terminal which serves as a second output terminal of the third current mirror circuit (NCM3) and which is connected electrically to the negative voltage supply (VSS), and a drain terminal which serves as a second input terminal of the third current mirror circuit (NCM3) and which is connected electrically to the first output terminal of the second current mirror circuit (NCM2).

An output field effect transistor (MO) has a gate terminal, a source terminal connected electrically to a signal source (VM), and a drain terminal connected electrically to the gate terminal thereof, to the second input terminal of the third current mirror circuit (NCM3), and to the first output terminal of the second current mirror circuit (NCM2). The output voltage signal (VO) is measured at the gate terminal of the output field effect transistor (MO). In the present embodiment, the output field effect transistor (MO) is an NMOS transistor, and the signal source (VM) supplies a negative voltage signal which has a voltage value equal to a threshold voltage of the output field effect transistor (MO).

In operation, the squaring circuit (M) initially receives the input voltage signals. At the same time, the squaring circuit (M) receives first and second current signals (IA and IB) respectively from the first and second terminals of the square-root circuit (N). The drain current (ID) of an NMOS device in the saturation region can be expressed as $$ID=K(VGS-VT)^2 \quad (1)$$

where K is the transconductance parameter, VGS is the gate-to-source voltage, and VT is the threshold voltage. Assuming that all the transistors in FIGS. 1 and 2 are biased in the saturation region with individual wells (not shown) connected to their sources to eliminate the body effect, and that the transconductance parameter and the threshold voltage of the transistors (M1,M2, M3,M4,M5,M6,M13,M14,M15,M16) are equal to K and VT, respectively, the currents (IX1,1, IX1,2, IX2,1 and IX2,2) in FIG. 2 can be determined as $$IX1,1=K(X1-V1-VT)^2 \quad (2)$$

$$IX1,2=K(-X1-V2-VT)^2 \quad (3)$$

$$IX2,1=K(X2-V1-VT)^2 \quad (4)$$

and $$IX2,2=K(-X2-V2-VT)^2 \quad (5)$$

Preferably the aspect ratio of the tenth transistor (M10) is twofold that of the ninth transistor (M9), while the aspect ratios of the eleventh (M11) is twofold that of the twelfth transistor (M12), too. Thus, the ninth and tenth transistors (M9 and M10) and the first current mirror circuit (MCM1) will force the current (Ia) to become zero, while the eleventh and twelfth transistor (M1]and M]2) and the second current mirror circuit (MCM2) will force the current (Ib) to become zero. If the fifth, sixth, seventh and eighth transistors (M5, M6, M7 and MS) are matched devices, one can obtain that V1=V2 since Ia=Ib=0. The current (I5,I6) that flows through the transistors (M5 and M7, M6 and M8) will be $$I5=I6=K(-V1-VT)^2=K7(VC-VSS-VT)^2 \quad (6)$$

wherein K7 (=K8) is the transconductance parameter of M7 (M8). If the first, second and third current mirror circuits (NCM1, NCM2 and NCM3) in FIG. 1 are active, the output current IO can be expressed as $$IO=IA-IB=(IX1,1)+(IX1,2)+(IX2,1)+(IX2,2)-(2*I5)-(2*I6)=2K(X1^2+X2^2) \quad (7)$$

In FIG. 1, the output field effect transistor (MO) is used as a simple current-to-voltage converter.

According to equation (1), the output voltage (VO) of the vector summation circuit is found to be $$VO=\sqrt{((2K/KO)*(X1^2+X2^2))} \quad (8)$$

where KO is the transconductance parameter of the output field effect transistor (MO).

Figure 3:
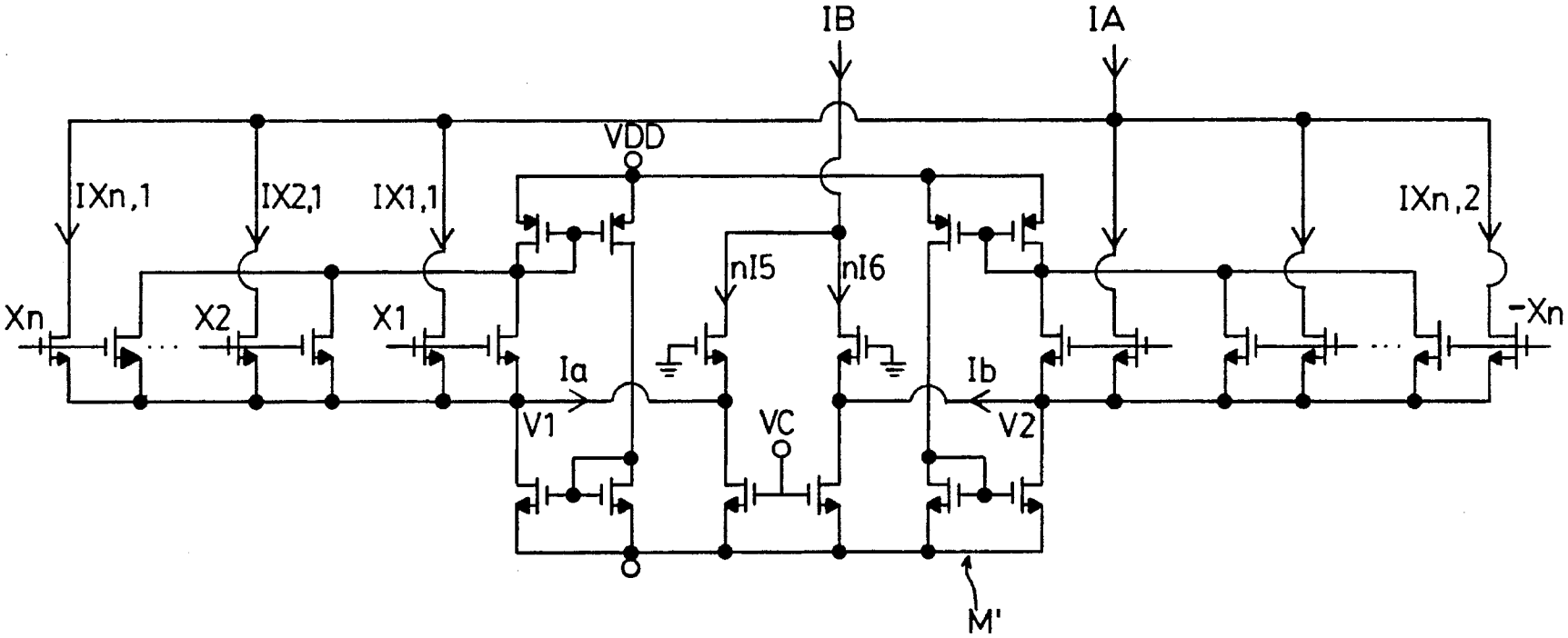
FIG. 3 is a schematic circuit diagram of a squaring circuit of a vector summation device according to a second embodiment of the present invention.

It should be appreciated that the squaring circuit (M) of the vector summation device according to the present invention may receive more than two input voltage signals. Referring to FIG. 3, a second embodiment is shown. Unlike the first embodiment, the number of input terminal pairs of the squaring circuit (M') is increased by adding Xn and −Xn stages such that the squaring circuit (M') can receive more than two input voltage signals. Since the working principle of a squaring circuit with more than two input voltage signals is similar to that of the squaring circuit with two input voltage signals, a detailed description thereof is thus omitted herein. For example, if the squaring circuit receives n input voltage signals, the aspect ratios of the fifth, sixth, seventh and eighth transistors (M5, M6, M7 and MS) are increased n times. The output current signal (IO) of the n-input vector summation device can be expressed as $$I0=\sum_{i=1}^{n}(IXi,1+IXi,2)-nI5-nI6=2K\sum_{i=1}^{n}Xi^2 \quad (9)$$

Therefore, the output voltage signal (VO) will be given by $$VO=\sqrt{((2K/KO)(X1^2+X2^2+\ldots+Xn^2))} \quad (10)$$

It should be noted that the vector summation device according to the present invention can be used as an RMS converter by employing a low-pass filter (not shown). The low-pass filter can be located between the gate terminal of the output field effect transistor (MO) and the junction of the drain terminal of the transistor (NCM32) and the source terminal of the transistor (NCM21), or can be located at the input terminals of each of the input terminal pairs of the squaring circuit.

The output current signal (IO) of the n-input RMS converter can be expressed as $$I0=\sum_{i=1}^{n}(IXi,1+IXi,2)-nI5-nI6=2K\sum_{i=1}^{n}av(Xi^2) \quad (11)$$

Therefore, the output voltage signal (VO) will be given by $$VO=\sqrt{((2K/KO)\mathrm{av}((X1^2+X2^2+\ldots+Xn^2)))} \quad (12)$$

While the present invention has been described in connection with what is considered the most practical and preferred embodiments, it is understood that this invention is not limited to the disclosed embodiments, but is intended to cover various arrangements included within the spirit and scope of the broadest interpretation so as to encompass all such modifications and equivalent arrangements.

I claim:

1. A vector summation device comprising a squaring circuit for receiving a number of input voltage signals, and a square-root circuit having first and second current terminals connected electrically to said squaring unit, said squaring circuit receiving first and second current signals respectively from said first and second current terminals of said square-root circuit, difference between current values of said first and second current signals being proportional to sum of squares of voltage values of said input voltage signals, said square-root circuit generating an output voltage signal with a voltage value proportional to square-root of said difference between said current values of said first and second current signals.

2. A vector summation device as claimed in claim 1, wherein said squaring circuit has an input terminal pair for receiving one of said input voltage signals, said squaring circuit comprising:

first and second field effect transistors having interconnected gate terminals which serve as a first input terminal of said input terminal pair and interconnected source terminals, each of said first and second transistors further having a drain terminal, said drain terminal of said first transistor being connected electrically to said first current terminal of said square-root circuit;

third and fourth field effect transistors having interconnected gate terminals which serve as a second input terminal of said input terminal pair and interconnected source terminals, each of said third and fourth transistors further having a drain terminal, said drain terminal of said fourth transistor being connected electrically to said drain terminal of said first transistor;

a fifth field effect transistor having a grounded gate terminal, a source terminal connected electrically to said source terminal of said second transistor, and a drain terminal connected electrically to said second terminal of said square-root circuit;

a sixth field effect transistor having a grounded gate terminal, a source terminal connected electrically to said source terminal of said third transistor, and a drain terminal connected electrically to said drain terminal of said fifth transistor;

a seventh field effect transistor having a gate terminal, a source terminal, and a drain terminal connected electrically to said source terminal of said second transistor;

an eighth field effect transistor having a gate terminal connected electrically to said gate terminal of said seventh transistor, a source terminal connected electrically to said source terminal of said seventh transistor, and a drain terminal connected electrically to said source terminal of said third transistor;

a ninth field effect transistor having a gate terminal, a source terminal connected electrically to said gate terminal thereof and to said drain terminal of said second transistor, and a drain terminal;

a tenth field effect transistor having a gate terminal connected electrically to said gate terminal of said ninth transistor, a source terminal, and a drain terminal connected electrically to said drain terminal of said ninth transistor;

a first current mirror circuit having a first input terminal connected electrically to said source terminal of said second transistor and a second input terminal connected electrically to said source terminal of said tenth transistor;

an eleventh field effect transistor having a gate terminal, a source terminal, and a drain terminal connected electrically to said drain terminal of said ninth transistor;

a twelfth field effect transistor having a gate terminal connected electrically to said gate terminal of said eleventh transistor, a source terminal connected electrically to said gate terminal thereof and to said drain terminal of said third transistor, and a drain terminal connected electrically to said drain terminal of said ninth transistor; and a second current mirror circuit having a first input terminal connected electrically to said source terminal of said eleventh transistor and a second input terminal connected electrically to said source terminal of said third transistor.

3. A vector summation device as claimed in claim 2, wherein said squaring circuit further has another input terminal pair for receiving another one of said input voltage signals, said squaring circuit further comprising:

thirteenth and fourteenth field effect transistors having interconnected gate terminals which serve as a first input terminal of said another input terminal pair and interconnected source terminals which are connected electrically to said source terminals of said first and second transistors, said thirteenth transistor further having a drain terminal connected electrically to said drain terminal of said first transistor, said fourteenth transistor further having a drain terminal connected electrically to said drain terminal of said second transistor; and fifteenth and sixteenth field effect transistors having interconnected gate terminals which serve as a second input terminal of said another input terminal pair and interconnected source terminals which are connected electrically to said source terminals of said third and fourth transistors, said fifteenth transistor further having a drain terminal connected electrically to said drain terminal of said third transistor, said sixteenth transistor further having a drain terminal connected electrically to said drain terminal of said first transistor.

4. A vector summation device as claimed in claim 2, wherein said first, second, third, fourth, fifth, sixth, seventh and eighth field effect transistors are NMOS field effect transistors.

5. A vector summation device as claimed in claim 2, wherein said ninth, tenth, eleventh and twelfth field effect transistors are PMOS field effect transistors.

6. A vector summation device as claimed in claim 3, wherein said thirteenth, fourteenth, fifteenth and sixteenth field effect transistors are NMOS field effect transistors.

7. A vector summation device as claimed in claim 1, wherein said square-root circuit comprises:

a first current mirror circuit having a first output terminal which is connected electrically to said squaring circuit and which serves as said second current terminal of said square-root circuit, and a second output terminal;

a second current mirror circuit having a first output terminal and a second output terminal which is connected electrically to said squaring circuit and which serves as said first current terminal of said square-root circuit;

a third current mirror circuit having a first input terminal connected electrically to said second output terminal of said first current mirror circuit and a second input terminal connected electrically to said first output terminal of said second current mirror circuit; and an output field effect transistor having a gate terminal, a source terminal connected electrically to a signal source, and a drain terminal connected electrically to said gate terminal thereof, to said second input terminal of said third current mirror circuit, and to said first output terminal of said second current mirror circuit, said output voltage signal being measured at said gate terminal of said output field effect transistor.

8. A vector summation device as claimed in claim 7, wherein said output field effect transistor is an NMOS field effect transistor.

9. A vector summation device as claimed in claim 7, wherein said signal source supplies a negative voltage signal having a voltage value equal to a threshold voltage of said output field effect transistor.

10. A vector summation device as claimed in claim 2, wherein said square-root circuit comprises:

a first current mirror circuit having a first output terminal which is connected electrically to said drain terminals of said fifth and sixth transistors of said squaring circuit and which serves as said second current terminal of said square-root circuit, and a second output terminal;

a second current mirror circuit having a first output terminal, and a second output terminal which is connected electrically to said drain terminals of said first, fourth, thirteenth and sixteenth transistors of said squaring circuit and which serves as said first current terminal of said square-root circuit;

a third current mirror circuit having a first input terminal connected electrically to said second output terminal of said first current mirror circuit and a second input terminal connected electrically to said first output terminal of said second current mirror circuit; and an output field effect transistor having a gate terminal, a source terminal connected electrically to a signal source, and a drain terminal connected electrically to said gate terminal thereof, to said second input terminal of said third current mirror circuit, and to said first output terminal of said second current mirror circuit, said output voltage signal being measured at said gate terminal of said output field effect transistor.

11. A vector summation device as claimed in claim 10, wherein said signal source supplies a negative voltage signal having a voltage value equal to a threshold voltage of said output field effect transistor.

12. A vector summation device as claimed in claim 10, wherein said output field effect transistor is an NMOS field effect transistor.

13. A vector summation device as claimed in claim 3, wherein said square-root circuit comprises:

a first current mirror circuit having a first output terminal which is connected electrically to said squaring circuit and which serves as said second current terminal of said square-root circuit, and a second output terminal;

a second current mirror circuit having a first output terminal and a second output terminal which is connected electrically to said squaring circuit and which serves as said first current terminal of said square-root circuit;

a third current mirror circuit having a first input terminal connected electrically to said second output terminal of said first current mirror circuit and a second input terminal connected electrically to said first output terminal of said second current mirror circuit; and an output field effect transistor having a gate terminal, a source terminal connected electrically to a signal source, and a drain terminal connected electrically to said gate terminal thereof, to said second input terminal of said third current mirror circuit, and to said first output terminal of said second current mirror circuit, said output voltage signal being measured at said gate terminal of said output field effect transistor.

14. A vector summation device as claimed in claim 13, wherein said output field effect transistor is an NMOS field effect transistor.

15. A vector summation device as claimed in claim 13, wherein said signal source supplies a negative voltage signal having a voltage value equal to a threshold voltage of said output field effect transistor.

* * * * *

UNITED STATES PATENT AND TRADEMARK OFFICE

CERTIFICATE OF CORRECTION

PATENT NO. : 5,506,538

DATED : April 9, 1996

INVENTOR(S) : Liu

It is certified that error appears in the above-indentified patent and that said Letters Patent is hereby corrected as shown below:

Col. 1, line 46, "detained" should be --detailed--.

Col. 2, line 19, "tile" should be --the--.

Col. 3, line 53 "MS" should be "M8".

Col. 5, line 28, "M1]" should be --M11--; "M]2" should be --M12--.

Col. 5, line 31, "MS" should be --M8--.

Col. 5, line 66, "MS" should be --M8--.

Col. 6, line 25, begin new paragraph with "While".

On the drawing, Sheet 2, insert --FIG. 2--.

Signed and Sealed this

Twenty-second Day of October, 1996

*Attest:*

Bruce Lehman

BRUCE LEHMAN

*Attesting Officer*

*Commissioner of Patents and Trademarks*